US010840627B1

(12) United States Patent
Su et al.

(10) Patent No.: US 10,840,627 B1
(45) Date of Patent: Nov. 17, 2020

(54) ELECTRICAL PLUG ASSEMBLY FOR REDUCING DROP DAMAGE TO PRONGS

(71) Applicant: Plume Design, Inc., Palo Alto, CA (US)

(72) Inventors: Ming-Tsung Su, Palo Alto, CA (US); Brian Nam, Palo Alto, CA (US)

(73) Assignee: Plume Design, Inc., Palo Alto, CA (US)

( * ) Notice: Subject to any disclaimer, the term of this patent is extended or adjusted under 35 U.S.C. 154(b) by 0 days.

(21) Appl. No.: 16/508,437

(22) Filed: Jul. 11, 2019

(51) Int. Cl.

| | |
|---|---|
| ***H01R 13/08*** | (2006.01) |
| ***H01R 43/20*** | (2006.01) |
| ***H01R 13/424*** | (2006.01) |
| ***H01R 13/15*** | (2006.01) |

(52) U.S. Cl.
CPC ..... *H01R 13/08* (2013.01); *H01R 13/15* (2013.01); *H01R 13/424* (2013.01); *H01R 43/20* (2013.01)

(58) Field of Classification Search
CPC ..... H01R 13/08; H01R 13/15; H01R 13/424; H01R 43/20
See application file for complete search history.

(56) References Cited

U.S. PATENT DOCUMENTS

| | | | | |
|---|---|---|---|---|
| 5,285,163 | A * | 2/1994 | Liotta | G01R 31/58 324/508 |
| 5,632,655 | A * | 5/1997 | DeMarco, Jr. | H01R 13/42 439/598 |
| 6,116,945 | A * | 9/2000 | Davis | H01R 13/5825 439/354 |
| 6,227,888 | B1 * | 5/2001 | Hahn | H01R 27/00 439/172 |
| 8,866,485 | B1 * | 10/2014 | Lacey | G01R 31/69 324/508 |
| 8,888,535 | B2 * | 11/2014 | Knight | H01R 13/5221 439/650 |
| 9,166,351 | B1 * | 10/2015 | Wang | H01R 27/00 |
| D790,460 | S | 6/2017 | Hibmacronan et al. | |
| D790,461 | S | 6/2017 | Hibmacronan et al. | |
| 9,985,397 | B2 * | 5/2018 | Jiang | H01R 13/5219 |
| 10,024,902 | B2 * | 7/2018 | Cabot | G01R 31/50 |
| 10,256,582 | B1 * | 4/2019 | Brandstatter | A47B 97/00 |
| 10,299,405 | B2 * | 5/2019 | Chang | H05K 7/20209 |
| 10,462,929 | B1 * | 10/2019 | Su | H01Q 13/10 |
| 10,490,957 | B1 * | 11/2019 | Brandstatter | H02G 3/18 |
| 10,561,135 | B2 * | 2/2020 | Sandford | A01M 1/02 |

(Continued)

*Primary Examiner* — Abdullah A Riyami
*Assistant Examiner* — Nader J Alhawamdeh
(74) *Attorney, Agent, or Firm* — Clements Bernard Walker; Lawrence A. Baratta, Jr.

(57) ABSTRACT

Disclosed embodiments include electrical plug assemblies for reducing drop damage to prongs, electrical devices with an electrical plug assembly for reducing drop damage to prongs, and methods of fabricating an electrical plug assembly for reducing drop damage to prongs. In a non-limiting, illustrative embodiment, an electrical plug assembly includes a rigid housing. A pair of flexible inserts is fixedly disposed in the rigid housing. Each of a pair of rigid sleeves is fixedly disposed in an associated one of the pair of flexible inserts. Each of a pair of electrically-conductive prongs is fixedly disposed in an associated one of the pair of rigid sleeves. Each of a pair of flexible electrical conductor assemblies is movably attached to an associated one of the pair of electrically-conductive prongs.

20 Claims, 12 Drawing Sheets

(56) References Cited

U.S. PATENT DOCUMENTS

| | | | | |
|---|---|---|---|---|
| 10,568,314 | B2 * | 2/2020 | Sandford | A01M 1/145 |
| 10,601,194 | B1 * | 3/2020 | Chien | H01R 13/652 |
| 2016/0274168 | A1 * | 9/2016 | Cabot | G01R 31/50 |
| 2019/0190115 | A1 | 6/2019 | Samardzija et al. | |
| 2020/0063952 | A1 * | 2/2020 | Rego | F21V 23/045 |

* cited by examiner

ELECTRICAL PLUG ASSEMBLY FOR REDUCING DROP DAMAGE TO PRONGS

FIELD OF THE DISCLOSURE

The present disclosure generally relates to electrical plug assemblies. More particularly, the present disclosure relates to electrical plug assemblies for reducing drop damage to prongs.

BACKGROUND OF THE DISCLOSURE

Electrical prongs are provided in an electrical plug assembly of an electrical device. The electrical prongs are configured to be plugged into an electrical outlet and electrically connect the electrical device to a source of electrical power. Electrical prongs suitably are made of electrically conductive material, as desired for a particular application. For example, in some applications, electrical prongs may be made of stainless steel or the like. Furthermore, conventional, known electrical prongs typically are rigidly mounted into an electrical plug assembly of an electrical device.

For example, and referring to FIG. 1, an electrical device 10 includes a conventional electrical plug assembly 11 known in the art with electrically-conductive electrical prongs 12. As discussed above, the electrical prongs 12 are made of suitable electrically conductive material, as desired for a particular application, such as stainless steel or the like. As also discussed above, the electrical prongs 12 are configured to be plugged into an electrical outlet (not shown) and electrically connect the electrical device 10 to a source of electrical power, such as that provided to the electrical outlet, thereby providing electrical power to the electrical device 10. Each of the electrical prongs 12 includes a pin 14 that includes a shaft 16. An end 18 of the pin 14 is rigidly mounted into a housing 20 of the plug 11. A tip 22 of the prong 12 is defined at end 24 of the pin 14. The tip 22 is configured to be plugged into an electrical outlet and electrically communicate with the electrical outlet, thereby electrically connecting the electrical device 10 to a source of electrical power that is electrically connected to the electrical outlet and providing electrical power to the electrical device 10. The shaft 16 is disposed in a sheath 26 that is made of an electrical insulator.

Electrical devices may be subject to being dropped including falling out of an electrical outlet. In some instances, a dropped electrical device may land on at least one electrical prong. Dropping of an electrical device and landing of the electrical device on at least one electrical prong may entail a not insubstantial impact and may impart a not insubstantial force to the affected electrical prong(s). As is also known, some electrical devices may entail a not insubstantial weight. If some such weighty electrical devices (with rigidly mounted electrical prongs as described above) were dropped as described above, then (as shown in FIG. 1) the affected electrical prong(s) 12 may be deformed (even if made from stainless steel) and/or the sheath 26 may be broken (as also shown in FIG. 1).

BRIEF SUMMARY OF THE DISCLOSURE

In an embodiment, an electrical plug assembly includes a rigid housing. A pair of flexible inserts is fixedly disposed in the rigid housing. Each of a pair of rigid sleeves is fixedly disposed in an associated one of the pair of flexible inserts. Each of a pair of electrically-conductive prongs is fixedly disposed in an associated one of the pair of rigid sleeves.

Each of a pair of flexible electrical conductor assemblies is movably attached to an associated one of the pair of electrically-conductive prongs.

In another embodiment, an electrical device includes an electrical plug assembly and electrical circuitry. The electrical plug assembly includes a rigid housing. A pair of flexible inserts is fixedly disposed in the rigid housing. Each of a pair of rigid sleeves is fixedly disposed in an associated one of the pair of flexible inserts. Each of a pair of electrically-conductive prongs is fixedly disposed in an associated one of the pair of rigid sleeves. Each of a pair of flexible electrical conductor assemblies is movably attached to an associated one of the pair of electrically-conductive prongs. The electrical circuitry is disposed in the rigid housing and is electrically couplable with the pair of flexible electrical conductor assemblies to receive electrical power from the pair of flexible electrical conductor assemblies.

In another embodiment, a method is provided for fabricating an electrical plug assembly. Each of a pair of electrically-conductive prongs is fixedly disposed in an associated one of a pair of rigid sleeves. Each of the pair of rigid sleeves is fixedly disposed in an associated one of a pair of flexible inserts. Each of a pair of flexible electrical conductor assemblies is movably attached to an associated one of the pair of electrically-conductive prongs. The pair of flexible inserts is disposed in a rigid housing.

The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the disclosures set forth herein.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various embodiments, the present disclosure relates to electrical plug assemblies for reducing drop damage to prongs, electrical devices with an electrical plug assembly for reducing drop damage to prongs, and methods of fabricating an electrical plug assembly for reducing drop damage to prongs.

Given by way of non-limiting overview, in various embodiments, an electrical plug assembly can help to reduce drop damage to prongs of the electrical plug assembly. As will be discussed in detail below, in various embodiments the prongs are disposed in flexible material—as opposed to rigid material as is known in the art—that may be able to help cushionably absorb energy associated with dropping of an electrical device that includes the electrical plug assembly. As such, the prong(s) may be able to flex in any direction—up, down, in, or out—to absorb impact forces if an attached electrical device were to be dropped and land on the prong(s). In such cases, damage to the prong(s) may be reduced or, in some cases, may possibly be substantially preventable.

Figure 1:
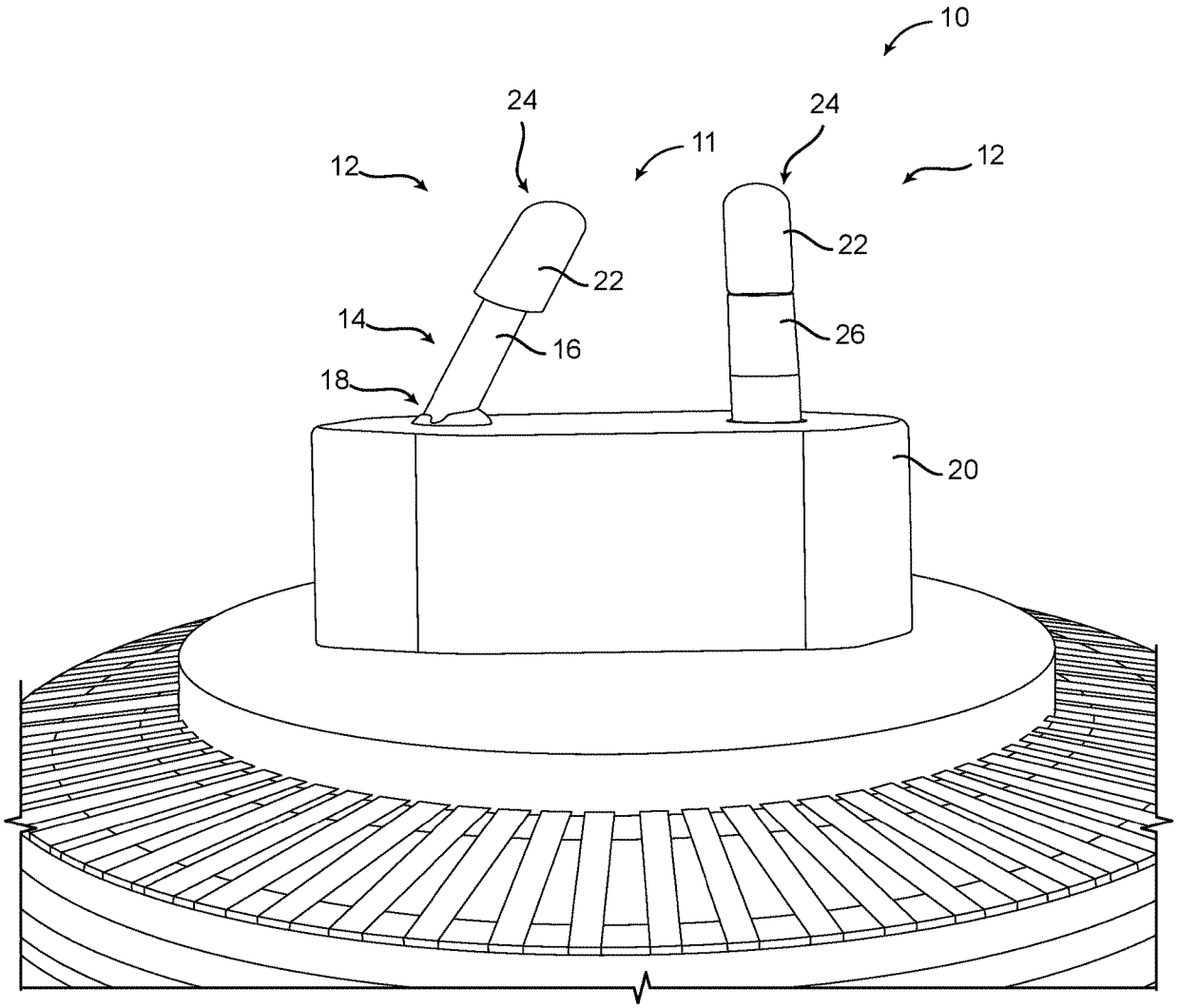
PRIOR ART FIG. 1
FIG. 1 is a front perspective view of a prior art electrical plug assembly with damaged prongs.
Figure 2A:
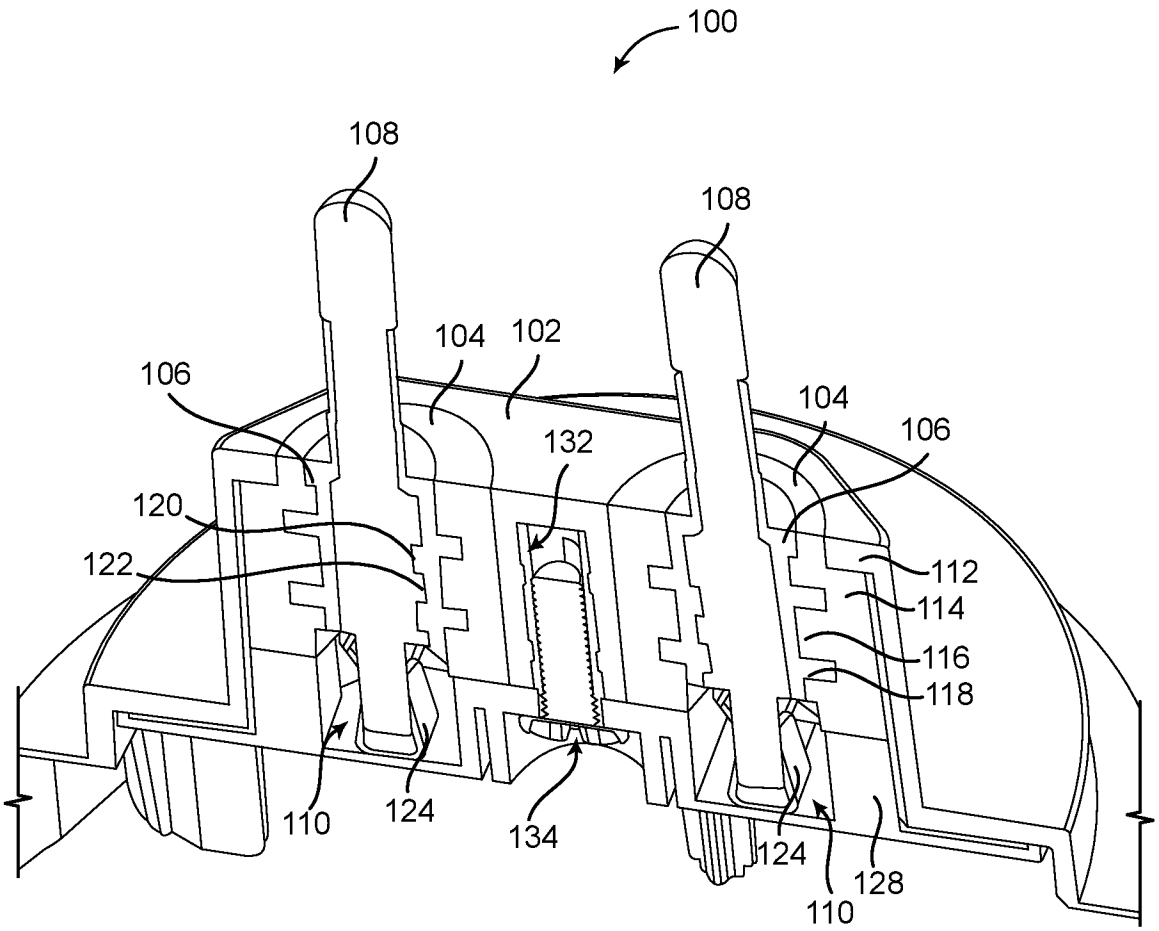
FIG. 2A is a front perspective view in cutaway, taken from a top angle, of an illustrative electrical plug assembly.

Referring now to FIG. 2A and still given by way of overview, in various embodiments an electrical plug assembly 100 includes a rigid housing 102. A pair of flexible inserts 104 is fixedly disposed in the rigid housing 102. Each of a pair of rigid sleeves 106 is fixedly disposed in an associated one of the pair of flexible inserts 104. Each of a pair of electrically-conductive prongs 108 is fixedly disposed in an associated one of the pair of rigid sleeves 106. Each of a pair of flexible electrical conductor assemblies 110 is movably attached to an associated one of the pair of electrically-conductive prongs 108.

Now that a non-limiting overview has been presented, details will be set forth by way of non-limiting examples given only by way of illustration.

Figure 2B:
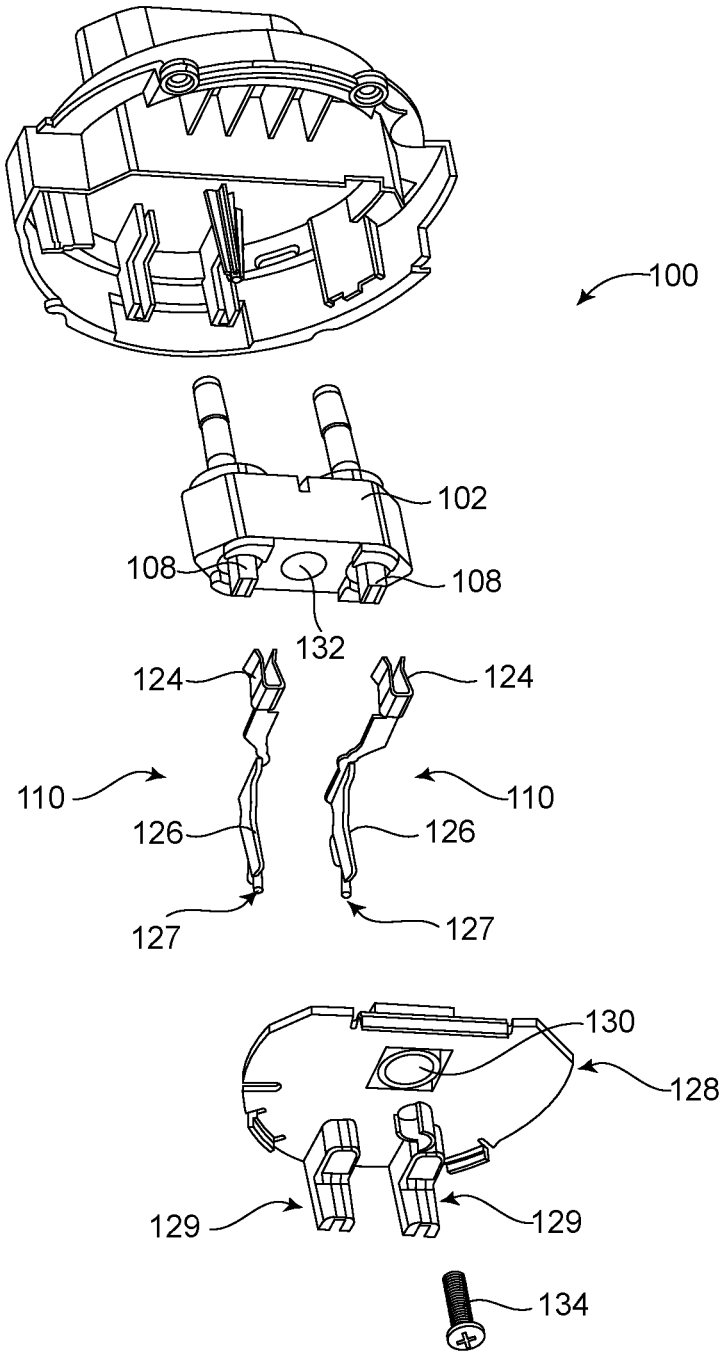
FIG. 2B is an exploded view of components of the electrical plug assembly of FIG. 2A.
Figure 2C:
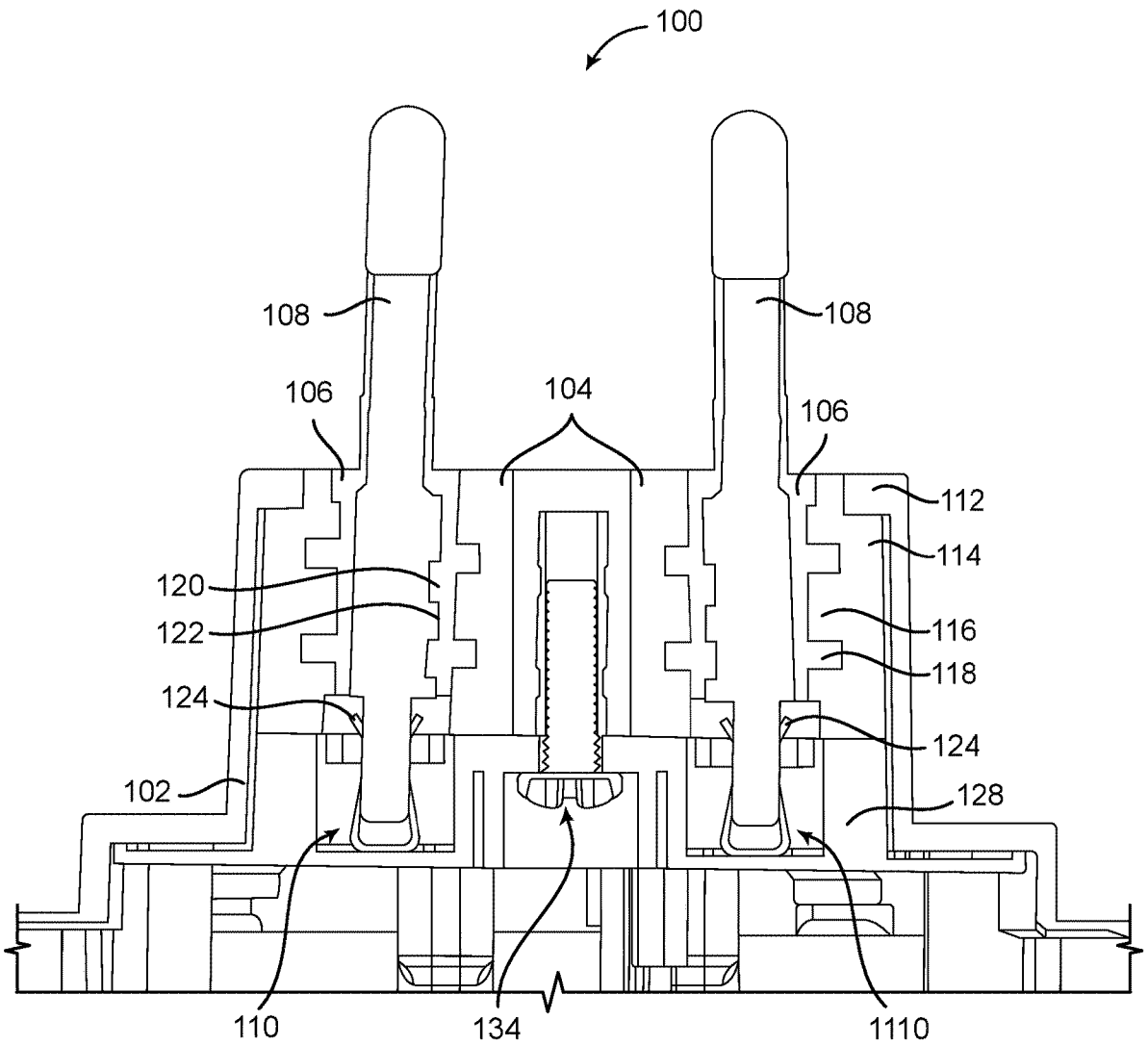
FIG. 2C is a front plan view in cutaway of the electrical plug assembly of FIG. 2A.
Figure 2D:
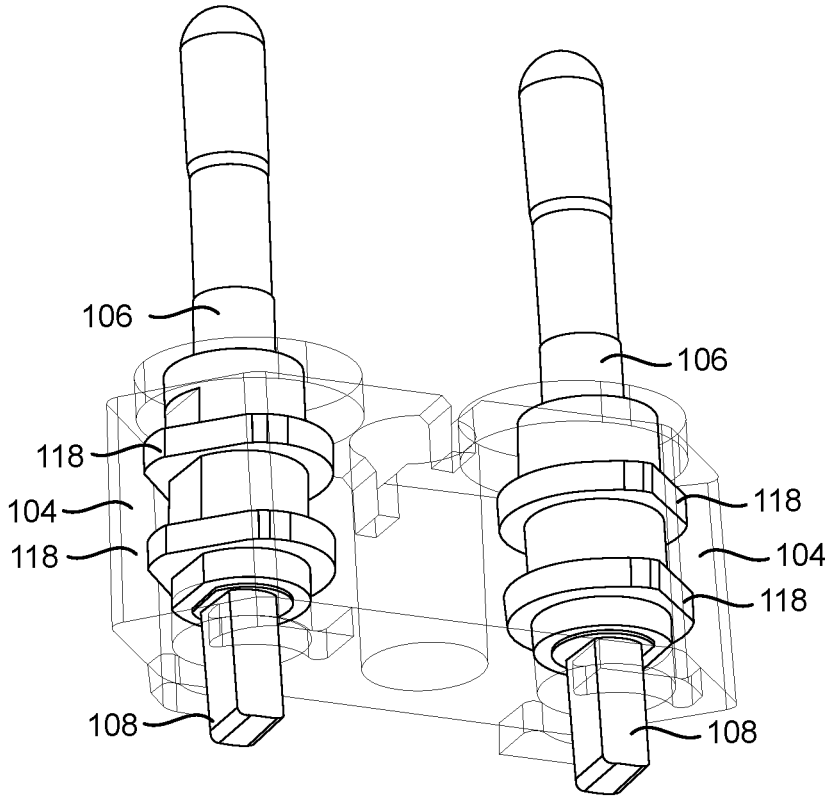
FIG. 2D is a front perspective view, taken from a bottom angle, of selected components of the electrical plug assembly of FIG. 2A.

Referring additionally to FIGS. 2B-2D, various features of the electrical plug assembly 100 will be explained by way of non-limiting examples given by way of illustration only. In various embodiments, the rigid housing 102 and the rigid sleeves 106 may be made from any suitable rigid material, such as plastic. It will be appreciated that the rigid material should also suitably be an electrical insulator.

In various embodiments, the flexible inserts 104 may be made from any suitable flexible material, such as rubber, that can help to absorb kinetic energy associated with impacts due to dropping of an electrical device (that is electrically (and physically) connected to the electrically-conductive prongs 108) onto one of the electrically-conductive prongs 108. That is, in various embodiments the flexible inserts 104 are made of flexible material, such as rubber, that can help to cushion the electrically-conductive prongs 108 yet is sufficiently firm to hold the electrically-conductive prongs 108 in the desired alignment.

In various embodiments and as shown in FIGS. 2A, 2C, and 2D, the electrical plug assembly 100 is constructed such that components of the electrical plug assembly 100 are held together despite being able to move. To that end, in various embodiments, the rigid housing 102 defines engagement features 112 and the flexible inserts 104 define engagement features 114 that are configured to matingly engage the engagement features 112. The flexible inserts 104 also define engagement features 116, and the rigid sleeves 106 define engagement features 118 that are configured to matingly engage the engagement features 116. The rigid sleeves 106 also define engagement features 120, and the electrically-conductive prongs 108 define engagement features 122 that are configured to matingly engage the engagement features 120. It will be appreciated that the engagement features 112, 114, 116, 118, 120, and 122 may have any geometrical shape as desired for a particular application, such as, for example, a fin, a ridge, a ledge, or the like.

In various embodiments and as shown in FIGS. 2A-2C, each of the flexible electrical conductor assemblies 110 includes an electrically conductive spring clip assembly 124 that is configured to frictionally engage an associated electrically-conductive prong 108. Each of the flexible electrical conductor assemblies 110 also includes a flexible, electrically-conductive wire 126 connected to the electrically-conductive spring clip assembly 124. The flexible, electrically-conductive wire 126 may be connected to the electrically-conductive spring clip assembly 124 in any suitable manner as desired, such as by soldering.

In various embodiments, ends 127 of the flexible, electrically-conductive wires 126 may be connected to electrical connectors 129. As discussed below, in various embodiments an electrical device (not shown in FIGS. 2A-2D) may be electrically connected to the electrical connectors 129 to receive electrical power.

In various embodiments and as shown in FIGS. 2A, 2C, and 2D, each flexible insert 104 is configured to urge an associated spring clip assembly 124 in movable attachment to an associated electrically-conductive prong 108. In such embodiments, each spring clip assembly 124 and its associated electrically-conductive prong 108 can be enabled to move freely and remain electrically connected. That is, in various embodiments the spring clip assembly 124 is electrically connected to its associated electrically-conductive prong 108 and can translate with its associated electrically-conductive prong 108. As such, it will be appreciated that, in various embodiments, some portions of the spring clip assembly 124 may be held in place with its associated electrically-conductive prong 108 while other portions of the spring clip assembly 124 (and/or its associated flexible, electrically conductive wire 126) may have surrounding space available in the rigid housing 102 in which it may move. In addition, in some embodiments each spring clip assembly 124 can be urged onto its associated electrically-conductive prong 108 during assembly.

In various embodiments, the flexible inserts 104 are held in place on a surface not in contact with the rigid housing 102 with a rigid plate 128. The rigid plate 128 defines a hole 130 therein, and the rigid housing 102 defines a threaded hole 132 therein that is aligned with the hole 130. A screw 134 is inserted through the hole 130, and threadedly engages the threaded hole 132 to urge the rigid plate 128 into contact with the flexible inserts 104. In some embodiments, the electrical connectors 129 may be disposed on the rigid plate 128.

Figure 3A:
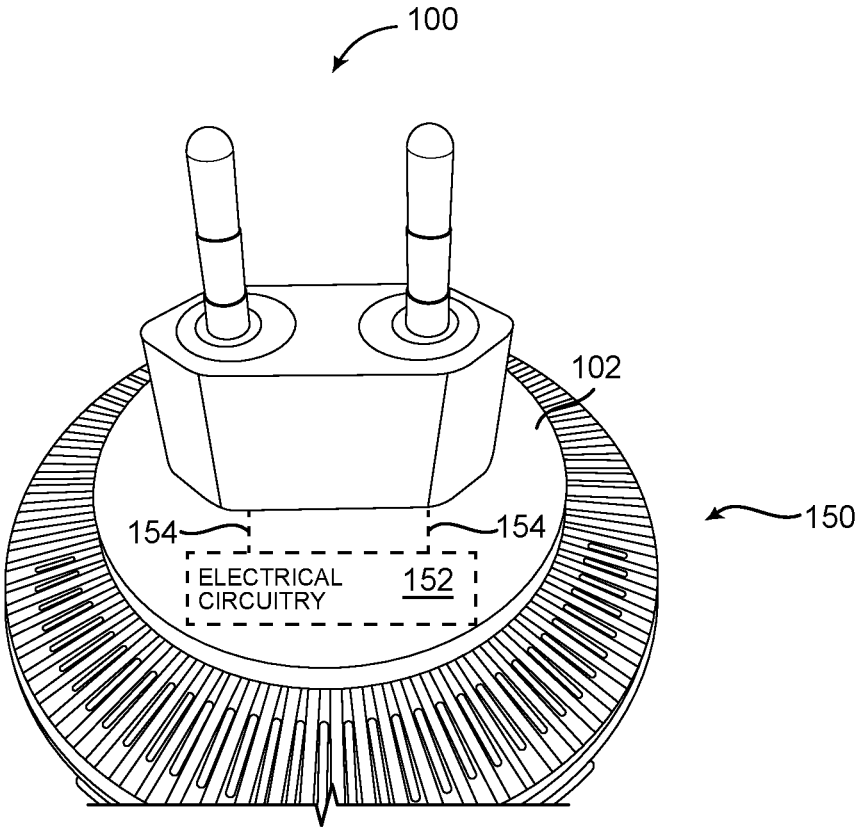
FIG. 3A is a front perspective view, taken from a top angle, of an illustrative electrical device that includes the electrical plug assembly of FIG. 2A.
Figure 3B:
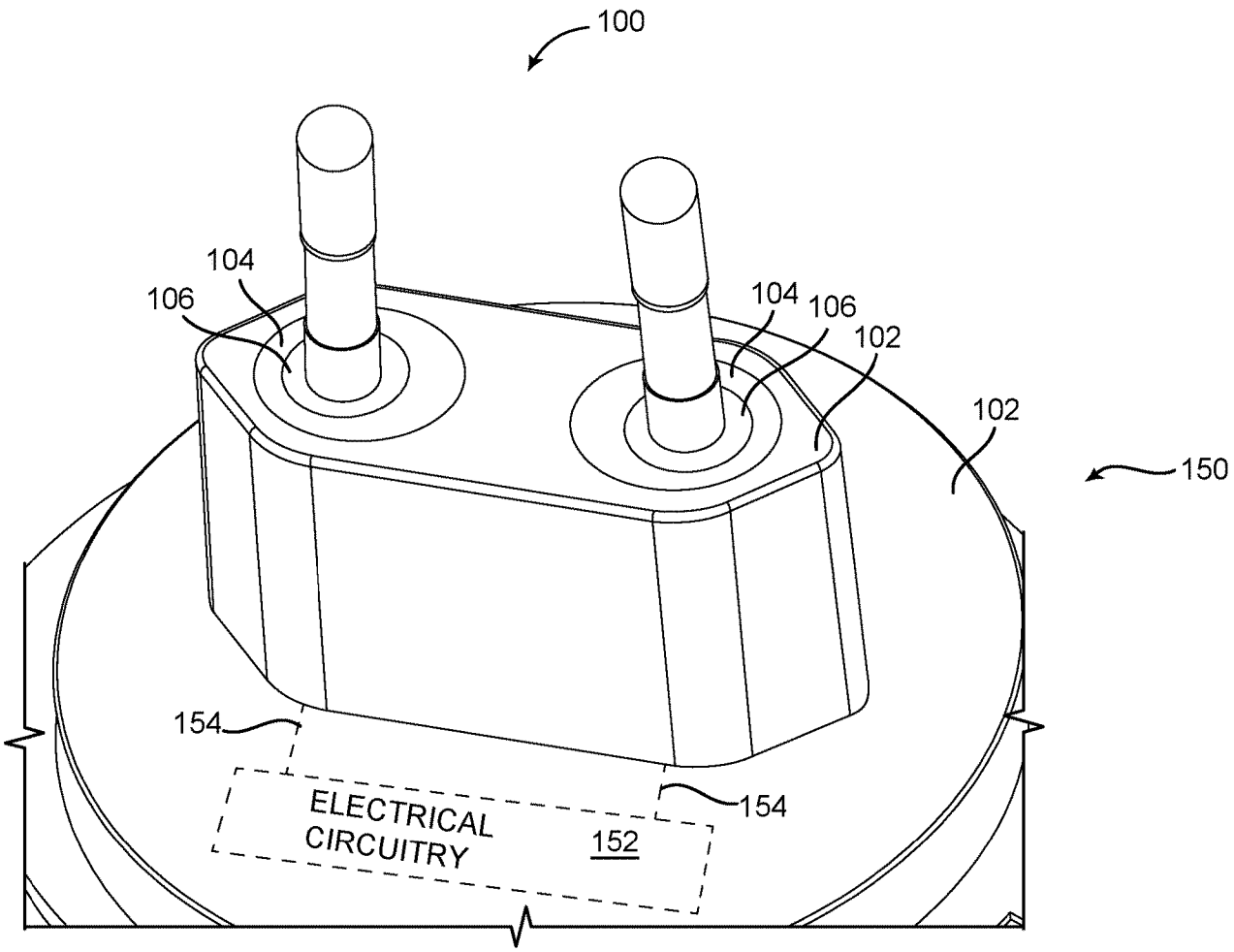
FIG. 3B is a front perspective view, taken from a top angle, of details of the electrical device of FIG. 3A.
Figure 3C:
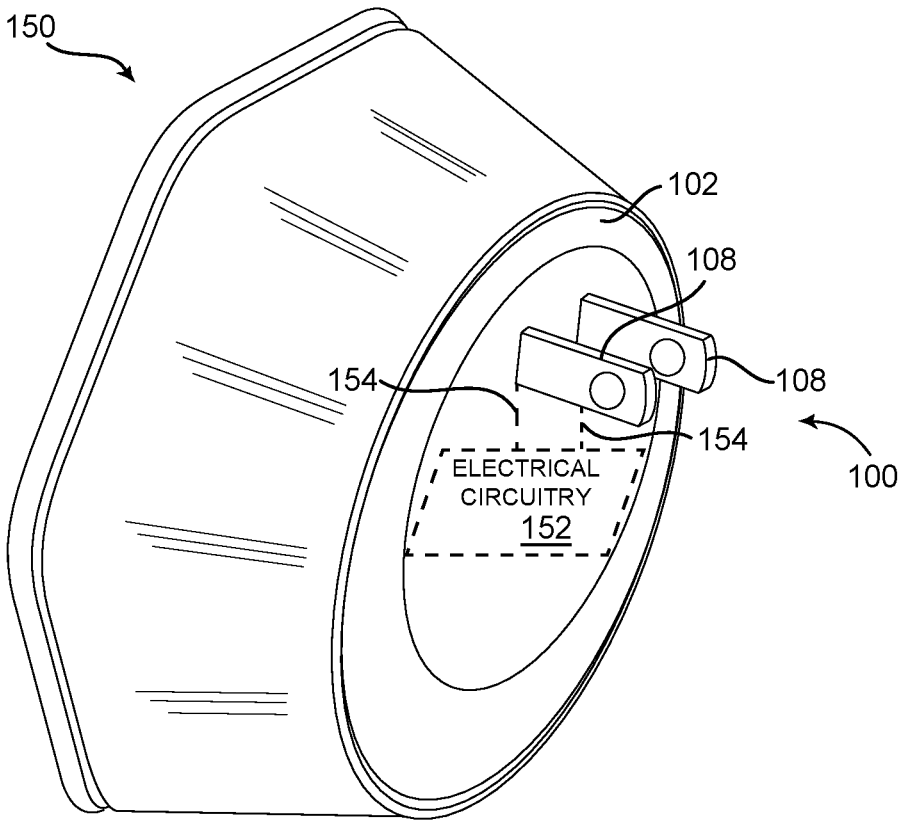
FIG. 3C is a side perspective view, taken from a top angle, of another illustrative electrical device that includes another illustrative electrical plug assembly.

Referring briefly in addition to FIG. 3C, in some embodiments and as shown in FIG. 3C the rigid sleeves 106 may terminate at an end at which the electrically-conductive prongs 108 protrude past the rigid housing 102. That is, in such embodiments the electrical plug assembly 100 suitably is configured to be plugged into a U.S. outlet. In some other embodiments and as shown in FIGS. 2A-2D, the rigid sleeves 106 may terminate at a location proximal a tip of the electrically-conductive prongs 108. That is, in such embodiments the electrical plug assembly 100 suitably is a European Union ("EU") Type C plug that is configured to be plugged into an EU-type outlet.

Referring additionally to FIGS. 3A-3C, in various embodiments an electrical device 150 includes the electrical plug assembly 100. Details regarding the electrical plug assembly 100 have been described above and need not be repeated for an understanding by those skilled in the art.

In various embodiments, the electrical device 150 includes electrical circuitry 152. The electrical circuitry 152 is disposed in the rigid housing 102. It will be appreciated that, in the electrical device 150, the rigid housing 102 is configured to house not only the electrical plug assembly 100 but also the electrical circuitry 152. In addition, in various embodiments, the rigid housing 102 is configured such that the electrical device 150 has a wall-pluggable form factor.

The electrical circuitry is electrically couplable with the flexible electrical conductor assemblies 110 (FIGS. 2A-2C) as indicated by electrical connections 154. In various embodiments, the electrical connections 154 may connect to the flexible electrical conductor assemblies 110 via the electrical connectors 129 (FIG. 2B).

It will be appreciated that the electrical circuitry 152 may be configured to affect any type of electrical device as desired for a particular application. Given by way of non-limiting example only by way of illustration and not of limitation, in some embodiments the electrical circuitry 152 may be configured to affect a wireless access point. Given by way of other non-limiting examples only by way of illustration and not of limitation, in some other embodiments the electrical circuitry 152 may be configured to affect a smoke detector, a carbon monoxide detector, emergency lighting, a timer for electrical devices such as lights or the like, a power supply for electronic devices, or any other type of electrical device as desired. It will again be appreciated that the electrical circuitry 152 may be configured to affect any type of electrical device as desired for a particular application, that no limitation to any particular type of electrical device is intended or implied, and that no limitation to any particular type of electrical device is to be inferred.

Following are a series of flowcharts depicting implementations. For ease of understanding, the flowcharts are organized such that the initial flowcharts present implementations via an example implementation, and thereafter the following flowcharts present alternate implementations and/or expansions of the initial flowchart(s) as either sub-component operations or additional component operations building on one or more earlier-presented flowcharts. Those having skill in the art will appreciate that the style of presentation utilized herein (e.g., beginning with a presentation of a flowchart(s) presenting an example implementation and thereafter providing additions to and/or further details in subsequent flowcharts) generally allows for a rapid and easy understanding of the various process implementations.

Figure 4A:
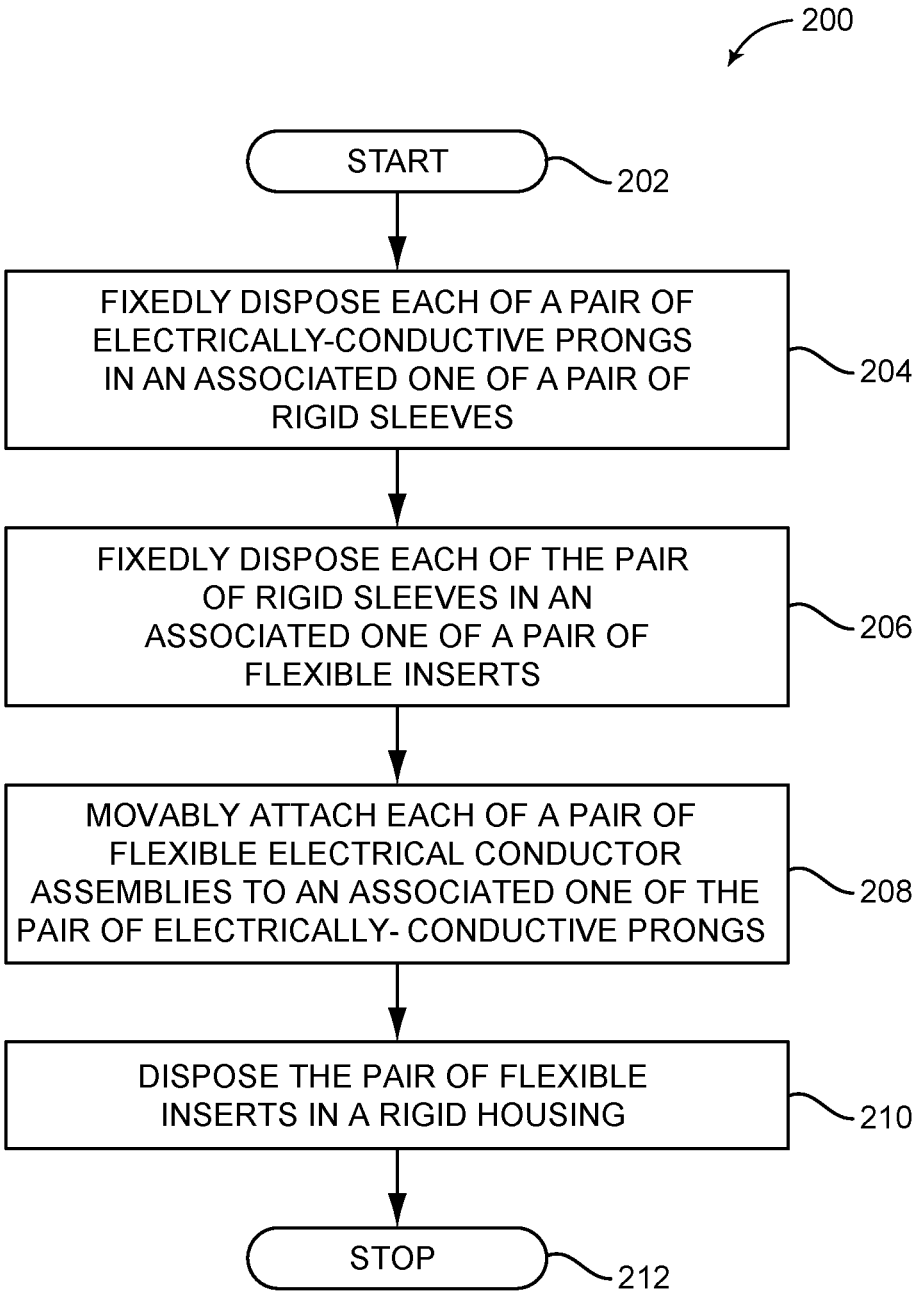
FIG. 4A is a flowchart of an illustrative method of fabricating an electrical plug assembly.

Referring now to FIG. 4A, an illustrative method 200 is provided for fabricating an electrical plug assembly. It will be appreciated that the method 200 may be well-suited for fabricating the electrical plug assembly 100, discussed above. The method 200 starts at a block 202. At a block 204 each of a pair of electrically-conductive prongs is fixedly disposed in an associated one of a pair of rigid sleeves. At a block 206, each of the pair of rigid sleeves is fixedly disposed in an associated one of a pair of flexible inserts. At a block 208, each of a pair of flexible electrical conductor assemblies is movably attached to an associated one of the pair of electrically-conductive prongs. At a block 210, the pair of flexible inserts is disposed in a rigid housing. The method 200 stops at a block 212.

Figure 4B:
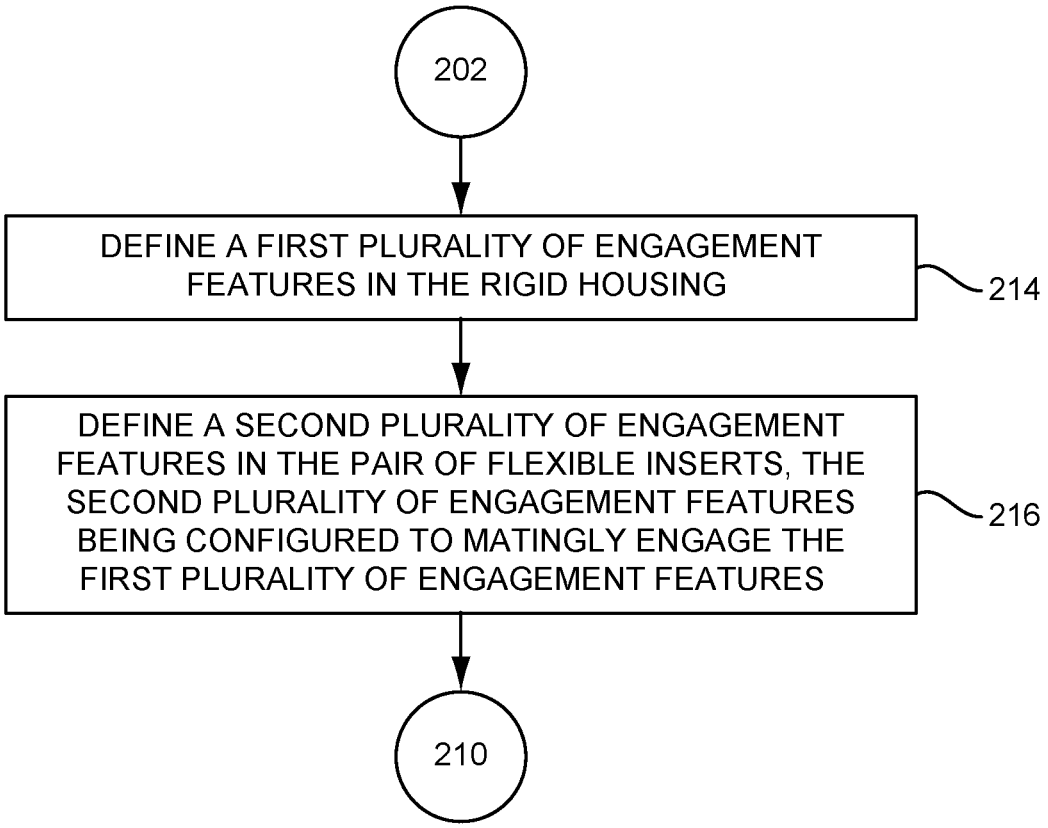
FIGS. 4B-4D illustrate the details of the method of FIG. 4A.

In various embodiments and referring additionally to FIG. 4B, the method 200 may further include defining a first plurality of engagement features in the rigid housing at a block 214 and defining a second plurality of engagement features in the pair of flexible inserts, the second plurality of engagement features being configured to matingly engage the first plurality of engagement features, at a block 216.

Figure 4C:
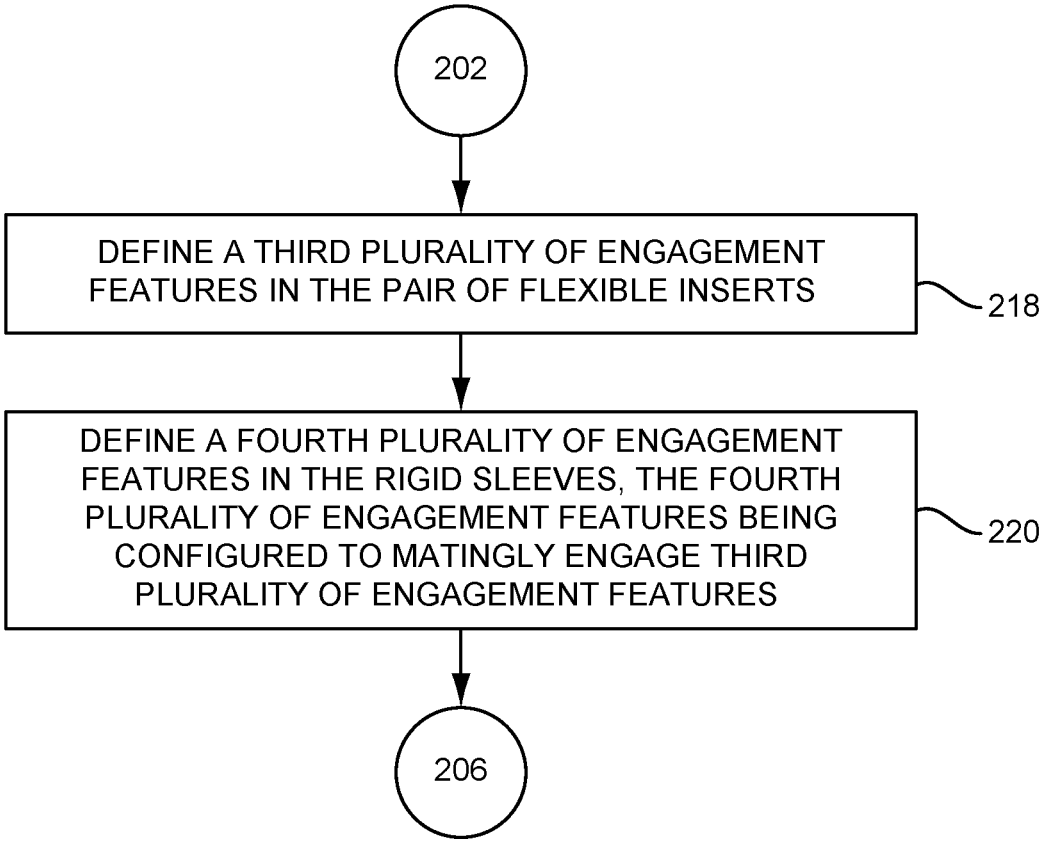

In various embodiments and referring additionally to FIG. 4C, the method 200 may further include defining a third plurality of engagement features in the pair of flexible inserts at a block 218 and defining a fourth plurality of engagement features in the rigid sleeves, the fourth plurality of engagement features being configured to matingly engage third plurality of engagement features, at a block 220.

Figure 4D:
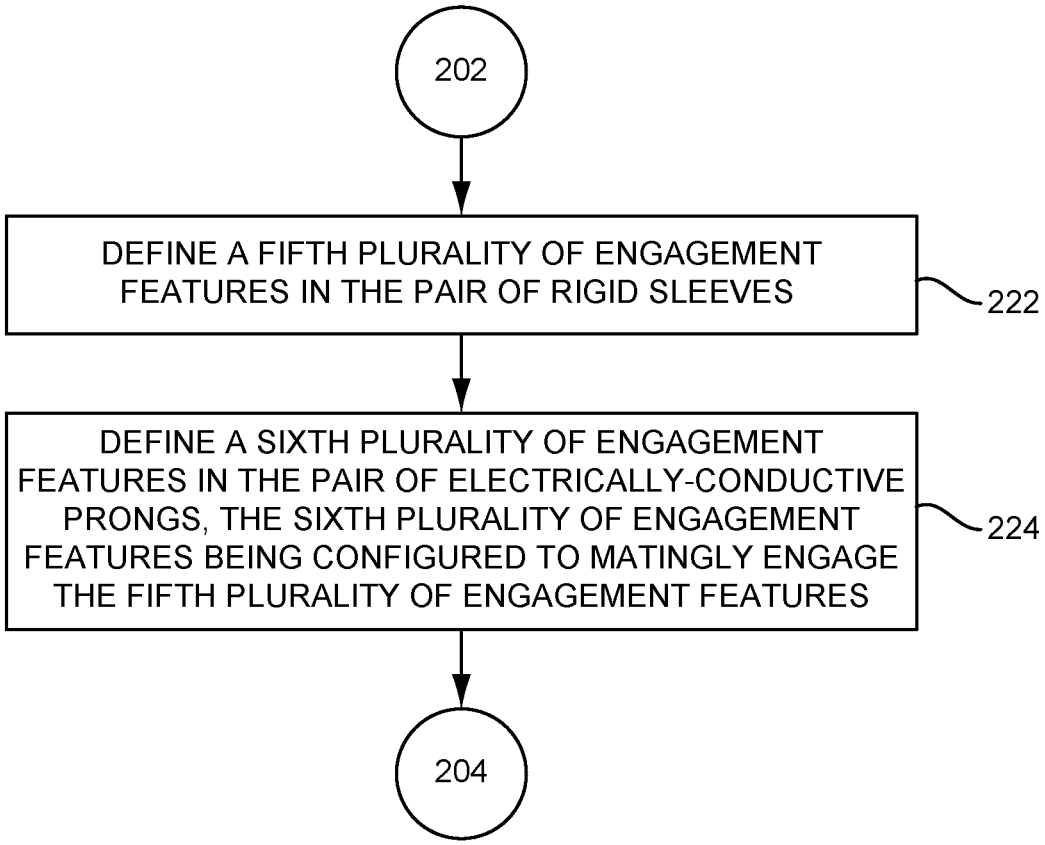

In various embodiments and referring additionally to FIG. 4D, the method 200 may further include defining a fifth plurality of engagement features in the pair of rigid sleeves at a block 222 and defining a sixth plurality of engagement features in the pair of electrically-conductive prongs, the sixth plurality of engagement features being configured to matingly engage the fifth plurality of engagement features, at a block 224.

It will be appreciated that some embodiments described herein may include one or more generic or specialized processors ("one or more processors") such as microprocessors; Central Processing Units (CPUs); Digital Signal Processors (DSPs): customized processors such as Network Processors (NPs) or Network Processing Units (NPUs), Graphics Processing Units (GPUs), or the like; Field Programmable Gate Arrays (FPGAs); and the like along with unique stored program instructions (including both software and firmware) for control thereof to implement, in conjunction with certain non-processor circuits, some, most, or all of the functions of the methods and/or systems described herein. Alternatively, some or all functions may be implemented by a state machine that has no stored program instructions, or in one or more Application Specific Integrated Circuits (ASICs), in which each function or some combinations of certain of the functions are implemented as custom logic or circuitry. Of course, a combination of the aforementioned approaches may be used. For some of the embodiments described herein, a corresponding device in hardware and optionally with software, firmware, and a combination thereof can be referred to as "circuitry configured or adapted to," "logic configured or adapted to," etc. perform a set of operations, steps, methods, processes, algorithms, functions, techniques, etc. on digital and/or analog signals as described herein for the various embodiments.

Moreover, some embodiments may include a non-transitory computer-readable storage medium having computer readable code stored thereon for programming a computer, server, appliance, device, processor, circuit, etc. each of which may include a processor to perform functions as described and claimed herein. Examples of such computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer-readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various embodiments.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. An electrical plug assembly comprising:

a rigid housing;

a pair of flexible inserts fixedly disposed in the rigid housing;

a pair of rigid sleeves, each of the pair of rigid sleeves being fixedly disposed in an associated one of the pair of flexible inserts such that each of the pair of flexible inserts is disposed between the rigid housing and a corresponding one of the pair of rigid sleeves;

a pair of electrically-conductive prongs, each of the pair of electrically-conductive prongs being fixedly disposed in an associated one of the pair of rigid sleeves; and a pair of flexible electrical conductor assemblies, each of the pair of flexible electrical conductor assemblies being movably attached to an associated one of the pair of electrically-conductive prongs.

2. The electrical plug assembly of claim 1, wherein:

the rigid housing defines a first plurality of engagement features; and the pair of flexible inserts defines a second plurality of engagement features that are configured to matingly engage the first plurality of engagement features.

3. The electrical plug assembly of claim 2, wherein:

the pair of flexible inserts defines a third plurality of engagement features; and the pair of rigid sleeves defines a fourth plurality of engagement features that are configured to matingly engage the third plurality of engagement features.

4. The electrical plug assembly of claim 3, wherein:

the pair of rigid sleeves defines a fifth plurality of engagement features; and the pair of electrically-conductive prongs defines a sixth plurality of engagement features that are configured to matingly engage the fifth plurality of engagement features.

5. The electrical plug assembly of claim 4, wherein the engagement features include a feature chosen from a fin, a ridge, and a ledge.

6. The electrical plug assembly of claim 1, wherein each of the pair of flexible electrical conductor assemblies includes:

an electrically conductive spring clip assembly configured to frictionally engage an associated one of the pair of electrically-conductive prongs; and a flexible, electrically-conductive wire connected to the electrically-conductive spring clip assembly, wherein the electrically conductive spring clip assembly for each pair of the flexible electrical conductor assemblies is configured to move freely with the associated one of the pair of electrically-conductive prongs while remaining connected to the electrically-conductive wire.

7. The electrical plug assembly of claim 5, wherein each of the pair of flexible inserts is configured to urge an associated spring clip assembly in movable attachment to an associated one of the pair of electrically-conductive prongs.

8. The electrical plug assembly of claim 1, wherein each of the pair of rigid sleeves terminates at an end chosen from a location at which the electrically-conductive prongs protrude past the rigid housing and a location proximal a tip of the electrically-conductive prongs.

9. An electrical device comprising:

an electrical plug assembly including:

a rigid housing;

a pair of flexible inserts fixedly disposed in the rigid housing;

a pair of rigid sleeves, each of the pair of rigid sleeves being fixedly disposed in an associated one of the pair of flexible inserts such that each of the pair of flexible inserts is disposed between the rigid housing and a corresponding one of the pair of rigid sleeves;

a pair of electrically-conductive prongs, each of the pair of electrically-conductive prongs being fixedly disposed in an associated one of the pair of rigid sleeves; and a pair of flexible electrical conductor assemblies, each of the pair of flexible electrical conductor assemblies being movably attached to an associated one of the pair of electrically-conductive prongs; and electrical circuitry disposed in the rigid housing, the electrical circuitry being electrically couplable with the pair of flexible electrical conductor assemblies.

10. The electrical device of claim 9, wherein the electrical circuitry is configured to affect a wireless access point.

11. The electrical plug assembly of claim 9, wherein:

the rigid housing defines a first plurality of engagement features; and the pair of flexible inserts defines a second plurality of engagement features that are configured to matingly engage the first plurality of engagement features.

12. The electrical plug assembly of claim 11, wherein:

the pair of flexible inserts defines a third plurality of engagement features; and the pair of rigid sleeves defines a fourth plurality of engagement features that are configured to matingly engage the third plurality of engagement features.

13. The electrical plug assembly of claim 12, wherein:

the pair of rigid sleeves defines a fifth plurality of engagement features; and the pair of electrically-conductive prongs defines a sixth plurality of engagement features that are configured to matingly engage the fifth plurality of engagement features.

14. The electrical plug assembly of claim 13, wherein the engagement features include a feature chosen from a fin, a ridge, and a ledge.

15. The electrical plug assembly of claim 9, wherein each of the pair of flexible electrical conductor assemblies includes:

an electrically conductive spring clip assembly configured to frictionally engage an associated one of the pair of electrically-conductive prongs; and a flexible, electrically-conductive wire connected to the electrically-conductive spring clip assembly, wherein the electrically conductive spring clip assembly for each pair of the flexible electrical conductor assemblies is configured to move freely with the associated one of the pair of electrically-conductive prongs while remaining connected to the electrically-conductive wire.

16. The electrical plug assembly of claim 15, wherein each of the pair of flexible inserts is configured to urge an associated spring clip assembly in movable attachment to an associated one of the pair of electrically-conductive prongs.

17. The electrical plug assembly of claim 9, wherein each of the pair of rigid sleeves terminates at an end chosen from a location at which the electrically-conductive prongs protrude past the rigid housing and a location proximal a tip of the electrically-conductive prongs.

18. A method of fabricating an electrical plug assembly, the method comprising:

fixedly disposing each of a pair of electrically-conductive prongs in an associated one of a pair of rigid sleeves;

fixedly disposing each of the pair of rigid sleeves in an associated one of a pair of flexible inserts such that each of the pair of flexible inserts is disposed between the rigid housing and a corresponding one of the pair of rigid sleeves;

movably attaching each of a pair of flexible electrical conductor assemblies to an associated one of the pair of electrically-conductive prongs; and disposing the pair of flexible inserts in a rigid housing.

19. The method of claim 18, further comprising:

defining a first plurality of engagement features in the rigid housing; and defining a second plurality of engagement features in the pair of flexible inserts, the second plurality of engagement features being configured to matingly engage the first plurality of engagement features.

20. The method of claim 19, further comprising:

defining a third plurality of engagement features in the pair of flexible inserts; and defining a fourth plurality of engagement features in the rigid sleeves, the fourth plurality of engagement features being configured to matingly engage a third plurality of engagement features.

* * * * *